United States Patent [19]

Schulze

[11] Patent Number: 4,516,462

[45] Date of Patent: May 14, 1985

[54] TREMOLO AND ELECTRONIC CONTROL DEVICE FOR STRINGED INSTRUMENTS

[76] Inventor: Arne Schulze, 2716 3rd St. #2, Santa Monica, Calif. 90405

[21] Appl. No.: 479,271

[22] Filed: Mar. 28, 1983

[51] Int. Cl.[3] ..... G10D 3/00; G10H 1/045; G10H 3/18

[52] U.S. Cl. ..... 84/1.16; 84/1.25; 84/313

[58] Field of Search ..... 84/1.16, 1.25, 313

[56] References Cited

U.S. PATENT DOCUMENTS 4,281,573 8/1981 Yarema ..... 84/1.16

4,387,621 6/1983 Franzmann ..... 84/1.16

*Primary Examiner*—Stanley J. Witkowski

[57] ABSTRACT

A device for controlling tremolo effects and electronic sound effects in an electric stringed instrument, which comprises;

manipulable means communicating with, and capable of providing control of, means for producing tremolo effects.

A portion of the manipulable means being itself individually manipulable and communicating with and capable of providing control of, means for producing electronic sound effects. The manipulable means and portion thereof being capable of individual, simultaneous manipulation to control tremolo and electronic sound effects.

12 Claims, 3 Drawing Figures

TREMOLO AND ELECTRONIC CONTROL DEVICE FOR STRINGED INSTRUMENTS

BACKGROUND OF THE INVENTION

1. Field of the Invention

This Invention relates to and has among its objects devices for control of tremolo and sound effects for electric stringed instruments.

2. Discussion of Prior art

Heretofore control of tremolo effects and electronic sound effects in stringed instruments has been obtained individually by separate devices. Simultaneous control of these effects was obtained primarily by employing hand and foot devices. Generally, the tremolo device is operated by hand while foot pedals or switches are employed for control of electronic effects.

In U.S. Pat. No. 2,741,146 there is disclosed a tremolo device for stringed instruments. The patented device comprises a bridge structure with a plurality of bridge elements to receive strings, means for independently adjusting the elements, and a bar adapted to recieve and anchor the strings. The device further includes yieldable tension means operable on said bridge structure and an arm extending from the bridge structure and manually engageable to oscillate the bridge structure and vary the tension on the strings. In this way the tremolo effect is produced.

U.S. Pat. No. 4,285,262 described a guitar tailpiece assembly including a tremolo device by which the strings may be stretched or relaxed in an oscillating manner. The invention includes a pivotable tremolo bar located behind the bridge of the guitar. A tremolo effect is achieved by oscillating a tremolo handle which is attached to the tremolo bar.

SUMMARY OF THE INVENTION

The invention described herein is a novel device for attachment to a stringed instrument which provides individual, simultaneous control of tremolo effects and electronic sound effects in a stringed instrument, such as a guitar. The device of the invention comprises manipulable means communicating with, and capable of providing control of, means for producing the tremolo effects. A portion of the above-described manipulable means is itself manipulable and communicates with, and is capable of providing individual control of, the electronic sound effects. Consequently, the manipulable means, including the portion thereof, are capable of individual, simultaneous manipulation to control the tremolo and electronic sound effects.

The primary advantage of the invention is that, for the first time, a single device is available providing individual, simultaneous control of both tremolo effects and electronic sound effects. As a result, the operator of a stringed instrument, e.g., a guitar, is able to control both effects by singular manipulation.

Another advantage of the present invention is the freedom of movement given to the operator of the stringed instrument. This is important particularly where the operator is a performer on a stage wherein the movement about the stage is necessary.

A further advantage of the invention is that, for the most part, the present device has a small size and is capable of fitting, e.g., into the palm of the hand of the operator of the stringed instrument.

DESCRIPTION OF THE PREFERRED EMBODIMENT

As mentioned above the device of the present invention comprises manipulable means communicating with, and capable of providing control of, means for producing tremolo effects. By the term manipulable is meant that the device is capable of a motion such as pivoting, rotating, sliding, switching, etc. Usually, the manipulable means is capable of manual manipulation, i.e., by action of the operator's hand. The manipulable means communicating with and capable of providing control of means for producing tremolo effects may be an arm which is connected, usually fixedly connected to a yieldable tailpiece communicating with the strings of the instrument. Such tailpieces are known in the art; for example those described in U.S. Pat. Nos. 2,741,146 and 4,285,262 (the disclosures of which are herein incorporated by reference).

A portion of the above manipulable means is itself manipulable and communicates with and is capable of providing control of electronic sound effects. This portion of the manipulable means can be individually manipulated to provide control of electronic sound effects while manipulation of the manipulable means controlling the tremolo effects is carried on simultaneously therewith. This portion of the manipulable means may take the form of rotatable handle attached to the manipulable means. The rotatable handle may include a potentiometer for communicating with the means for producing electronic sound effects. The aforementioned portion of the manipulable means may alternatively be a sliding handle communicating with a slide potentiometer for control of the electronic sound effects. A third alternative for the above-mentioned portion is a switchable means electronically communicating with the means for producing the electronic sound effects. Usually, this switchable portion may be operated by a finger. The means for providing electronic sound effects are well-known in the art.

The invention is further described with reference to the attached drawings.

Figure 1:
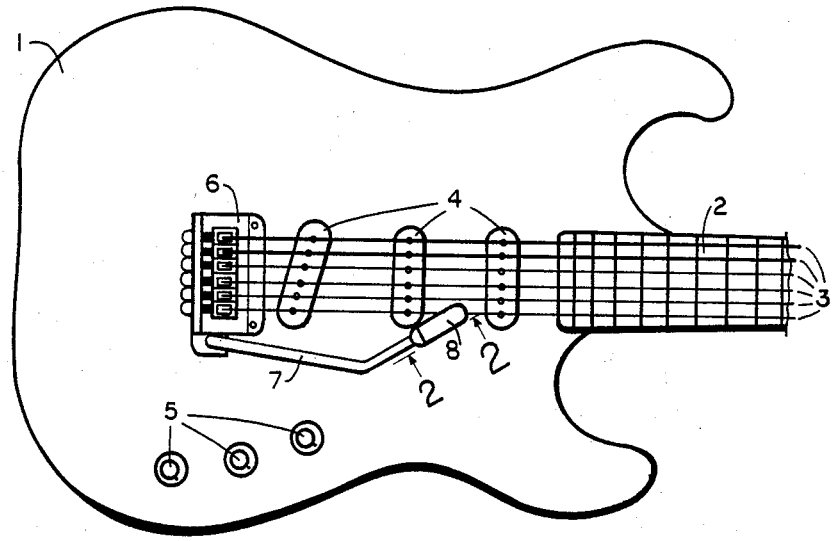
FIG. 1 is a fragmentary top view of a guitar incorporating the invention.

FIG. 1 shows the invention as embodied in an electric guitar having a body 1, which may be solid. A neck 2 extends from the body 1 and terminates in a head (not shown) having tuning pegs or other means to which the strings 3 are attached thereto. The strings 3 extend from a tailpiece to be described hereinafter, over the body 1 and neck 2 to the head (not shown).

Set within the body is one or more pickup units. In the guitar configuration shown in FIG. 1 there are three electromagnetic pickup units 4 mounted in the body 1 below the strings 3. The guitar includes several control knobs and switches 5, outlet jack (not shown) and like electric devices which are typically found in electric guitars. The construction so far described, for purpose of the present invention may be considered as conventional.

Figure 2:
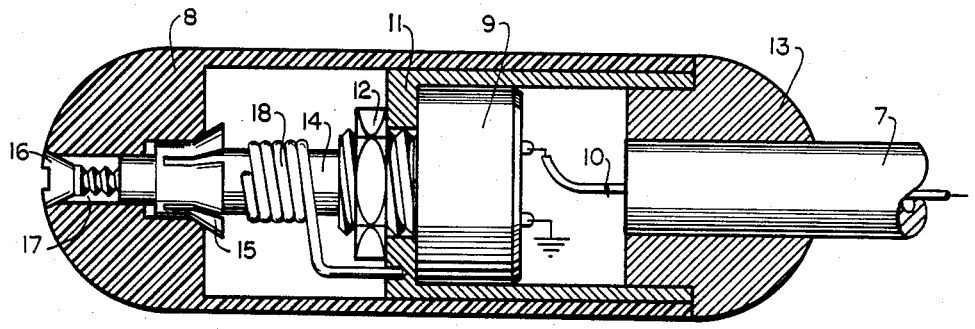
FIG. 2 is an enlarged fragmentary sectional view through 2—2 of FIG. 1.
Figure 3:
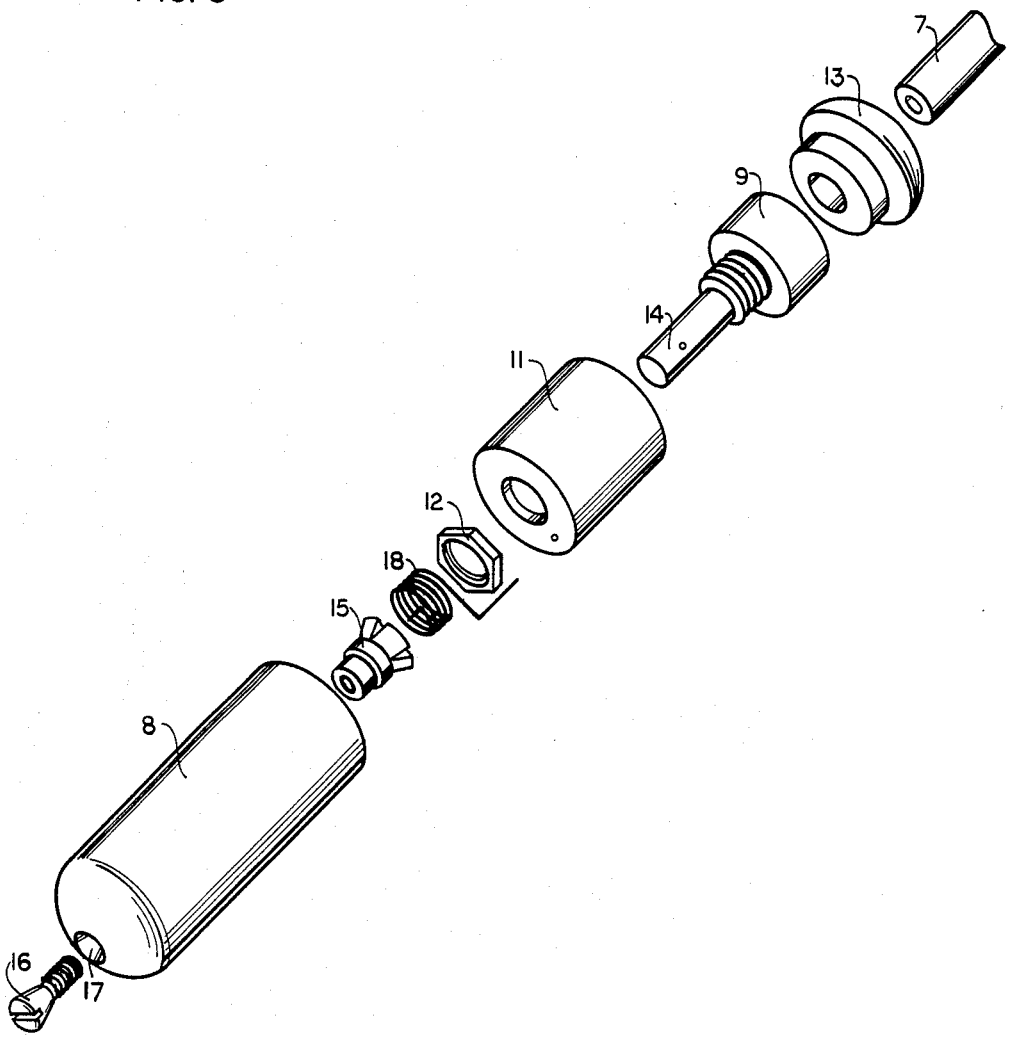
FIG. 3 is an enlarged exploded view of the tremolo arms revolving handle.

The tailpiece is a yieldable tremolo bar 6 mounted to the body 1, providing limited pivotal movement from a predetermined normal position in a string tensioning and string relaxing direction to enable the strings 3 to be tensioned or relaxed. The tremolo bar 6 may be operated by pivoting it in a direction which will vary the tension of the strings 3 by a tremolo arm 7 being connected to the tremolo bar 6. Fig.2 shows an enlarged fragmentary sectional view of the tremolo arm handle 8.

Incorporated in tremolo arm 7 and handle 8 is a potentiometer 9 connected to the electronics of the guitar to provide an additional volume control of the amplified output of the guitar by means of a wire 10 leading through tremolo arm 7. The potentiometer 9 is incorporated in housing 11 attached by means of nut 12. Housing 11 is attached to tremolo arm 7 by means of integrally formed extension bracket 13. Handle 8 of tremolo arm 7 is an outer housing surrounding inner housing 11 and is attached to narrowed axial portion 14 of the potentiometer 9 by means of collet 15. Collet 15 is tightened to potentiometer 9 through 14 by means of a screw 16 leading through a hole 17 in outer housing 8. Spring 18 is connected between inner housing 11 and the portion 14 of potentiometer 9, forcing outer housing 8 and potentiometer 9 to return to a normal playing position when not in operation. It will be observed that by reason of the rotatable connection between outer housing 8 (being the tremolo arm control handle, resting in the palm of the player's hand) and the tremolo arm 7, the player is provided individual and simultaneous operational control of: (1) Tremolo arm 7 to apply variable tension to strings 3 of the guitar to provide a tremolo effect, (2) handle 8 to control eIectronic sound effects such as the guitars amplified attack and rise time (amplified volume).

From the foregoing it will be appreciated that the embodiment described provides manually manipulable means capable of providing individual and simultaneous operational control of tremolo effects and electronic sound effects of the guitar by means of the same device.

While the above description contains many specificities, these should not be construed as limitations on the scope of the invention but rather as illustrative of one embodiment thereof. Many other variations are possible. For example, the potentiometer incorporated into the invention could provide control of:

(a) echo effects; input signal, volume of echo, length of echo, speed of echo
(b) chorus effects; speed of chorus, depth of chorus
(c) flanging effects; depth of flanging, speed of flanging
(d) distortion/sustain/overdrive
(e) phasing effects
(f) equalization or a varity of other electronic sound effects known in the art.

In addition, a slide potentiometer could be incorporated in the inner housing attached to the tremolo arm instead of a potentiometer with a revolving axial portion. The outer housing being attached to the sliding device of the potentiometer would provide manual manipulable control of the potentiometer by means of sliding the handle back and forth.

Alternatively, a variety of switches could be incorporated in the handle of the tremolo arm such as one or more buttons, triggers or other manual manipulable devices providing control of electronic sound effects by either squeasing, sliding, rotating, releasing, pulling or the like. It should be understood that the foregoing descriptions of the invention are extended merely to be illustrative thereof and that other embodiments and modifications may be apparent to those skilled in the art without departing from it's spirits.

Having thus described the invention, what is claimed is:

1. A guitar system including a single arm for controlling both tremolo effects and output volume comprising:

an electric guitar;

means for controlling tremolo effects by stretching and relaxing the strings of the guitar, said means including a movable tailpiece for holding the strings, and a tremolo arm mechanically coupled to said tailpiece, said arm extending to the area of playing the guitar; and manually operable electronic control means mounted on said tremolo arm for controlling and varying the output volume from said guitar;

whereby the guitar player may control both the output electronic sound effects of the guitar and the tremolo effects, with the same hand normally employed for plucking the guitar.

2. A guitar system as defined in claim 1 wherein said electronic control means is a potentiometer mounted on the free end of said arm.

3. A guitar system as defined in claim 1 wherein handle means for operating said electronic control means is mounted near the free end of said arm for rotation relative to said arm.

4. A guitar system as defined in claim 1 wherein handle means for operating said electronic control means is mounted near the free end of said arm handle for movement relative to said arm.

5. A guitar system including a single arm for controlling both tremolo effects and output electronic sound effects comprising:

an electric guitar;

means for controlling tremolo effects by stretching and relaxing the strings of the guitar, said means including a movable tailpiece for holding the strings and a tremolo arm mechanically coupled to said tailpiece, said arm extending to the area of playing the guitar; and manually operable electronic control means mounted on said tremelo arm for controlling and varying the output electronic sound effects from said guitar;

whereby the guitar player may control both the output electronic sound effects of the guitar and the tremelo effects, with the same hand normally employed for plucking the guitar.

6. A guitar system as defined in claim 5, wherein said electronic control means is a potentiometer mounted on the free end of said arm.

7. A guitar system as defined in claim 5 wherein handle means for operating said electronic control means is mounted near the free end of said arm for rotation relative to said arm.

8. A guitar system as defined in claim 5 wherein handle means for operating said electronic control means is mounted near the free end of said arm for movement relative to said arm.

9. A guitar system including a single arm for controlling both tremolo effects and output electronic sound effects comprising:

an electric guitar;

means for controlling tremolo effects by stretching and relaxing the strings of the guitar, said means including a movable tailpiece for holding the strings and a tremolo arm mechanically coupled to said tailpiece, said arm extending to the area of playing the guitar; and manually operable electronic control means for controlling and varying the output electronic sound effects from said tremolo arm;

whereby the guitar player may control both the output electronic sound effects of the guitar and the tremolo effects with the same hand normally employed for plucking the guitar.

10. A guitar system as defined in claim 9 wherein said electronic control means is a potentiometer mounted on the outer end of said arm.

11. A guitar system as defined in claim 9 wherein handle means for operating said electronic control means is mounted near the free end of said arm for rotation relative to said arm.

12. A guitar system as defined in claim 9 wherein handle means for operating said electronic control means is mounted near the free end of said arm for movement relative to said arm.

* * * * *